United States Patent [19]

Kasdagly

[11] Patent Number: 4,577,918

[45] Date of Patent: Mar. 25, 1986

[54] COPPER AND DUAL DUROMETER RUBBER MULTIPLE CONNECTOR

[75] Inventor: Dino G. Kasdagly, Rome, Pa.

[73] Assignee: International Business Machines Corporation, Armonk, N.Y.

[21] Appl. No.: 606,086

[22] Filed: May 1, 1984

[51] Int. Cl.[4] ..... H01R 9/09

[52] U.S. Cl. ..... 339/17 M; 264/135; 264/174; 339/61 M

[58] Field of Search ..... 339/17 M, 17 LM, 59 M, 339/61 M, DIG. 3; 174/117 F; 264/135, 148, 174

[56] References Cited

U.S. PATENT DOCUMENTS

| | | | |
|---|---|---|---|
| 2,067,405 | 1/1937 | Mayne | 174/110 AR |
| 2,663,844 | 12/1953 | Earle et al. | 339/61 M |
| 3,199,067 | 8/1965 | Stutzman | 339/61 M |
| 3,818,414 | 6/1974 | Davies et al. | 339/17 M |
| 3,991,463 | 11/1976 | Squitieri et al. | 339/59 M |
| 4,221,756 | 9/1980 | Piper et al. | 174/117 F |
| 4,255,003 | 3/1981 | Berg | 339/17 LM |
| 4,402,562 | 9/1983 | Sado | 339/61 M |

*Primary Examiner*—Neil Abrams
*Attorney, Agent, or Firm*—Mark Levy

[57] ABSTRACT

A high density electrical connector for use between semiconductor module boards. The connector has a rigid member and a flexible member connected to it, which provides elastomeric contact pressure. The rigid and flexible members are embodied in a dual durometer rubber layer having a relatively high durometer layer for the rigid member and a relatively low durometer layer for the flexible member. The relatively low durometer layer has circuit connector leads disposed thereon on the side facing away from the relatively high durometer layer. During the positioning of the electrical conductor into the relatively low durometer layer by pressing against a circuit board, a wiping action occurs to clean dust particles and other contaminants from the connector surface prior to forming an electrically conductive bond thereon.

7 Claims, 6 Drawing Figures

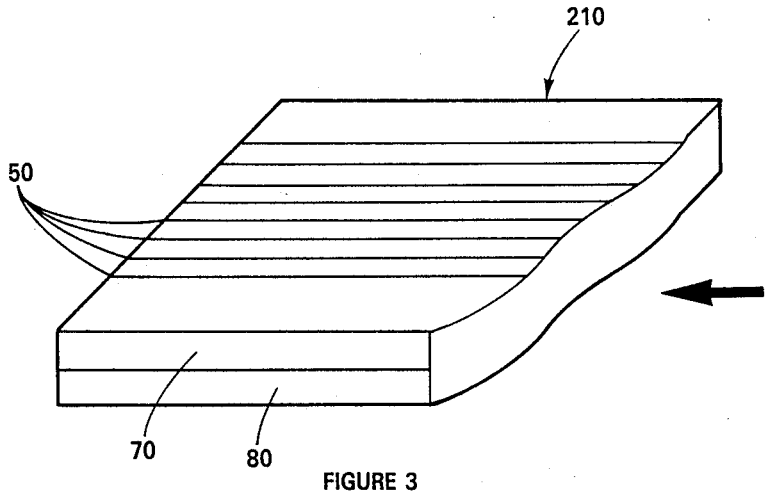
FIGURE 3
FIGURE 4
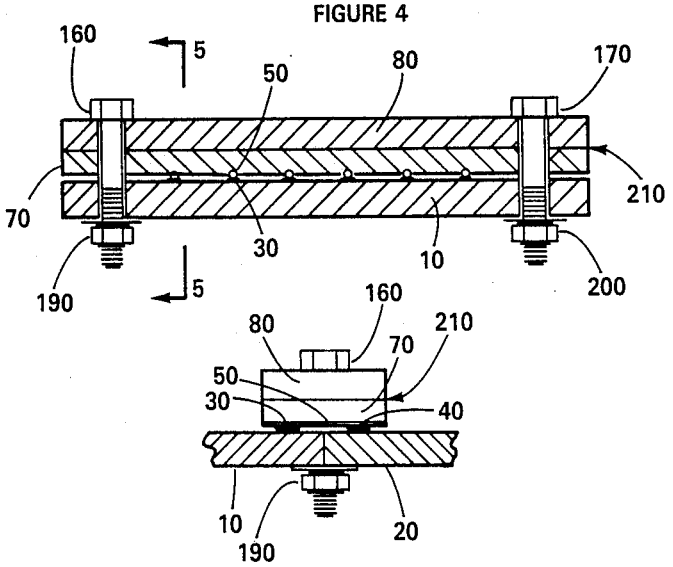
FIGURE 5

COPPER AND DUAL DUROMETER RUBBER MULTIPLE CONNECTOR

This patent application is related to concurrently filed patent application Ser. No. 606,087 for "Circuitry on Mylar and Dual Durometer Rubber Multiple Connector" by D. G. Kasdagly et al. and assigned to the present assignee.

BACKGROUND OF THE INVENTION

This invention relates to electrical connectors for high-density electrical circuits and more particularly to an elastomeric contact pressure device for establishing electrical connections between circuits on adjacent cards or printed circuit boards.

Nowadays, highly integrated semiconductor modules are mounted on cards which may be plugged into circuit boards. High-density connector leads are provided for coupling the modules to other devices on the same or on other boards. Separate entities of high computing and memory capacity are created by interconnecting cards or boards, each comprising at least one semiconductor module. Such interconnection of adjacent cards or circuit boards, comprising highly integrated semiconductor modules and associated dense connector leads, is even more critical than off-card connections where card circuitry can be connected to input/output cabling on a rigid frame.

Generally speaking, the requirements for card-to-card or board-to-board connectors, connecting semiconductor circuitries in adjacent modules, are the following:

(a) the distance covered by the contact should be as short as possible;
(b) positive mechanical retention of contact elements should be provided;
(c) the connector elements should be held in position under positive spring action; and
(d) high rigidity and stiffness of the clamping member should provide for equal and uniform spring action.

U.S. Pat. No. 4,057,311 issued to Evans discloses an electrical board-to-board connector for coupling semiconductor module circuits on two spaced-apart cards. According to the teaching of this reference, two boards to be connected are mounted in different planes with edges overlapping, the connector body with multiple parallel connection elements being sandwiched between the overlapping edges of the two adjacent boards. This approach requires connector leads to be placed on oppositely directed sides of the boards.

U.S. Pat. No. 3,597,660 issued to Jensen, et al discloses an off-card connector for coupling high-density edge conductors on module circuit boards with input-/output circuit conductors of a cabling network. The overlays are formed on a flexible thin layer of polyimide material by printed circuit techniques and contact pressure is achieved through a resilient body under a pressure applying mechanism.

A major problem associated with connecting electrical circuits on separate circuit boards and providing an electrical connection therebetween, especially during the assembly process, is the potential for attracting dust or other contaminants to the connectors. It is important that the electrical connection be of high quality, due to the relatively small dimensions of the electrical lines. The integrity of the electrical connections is a function of the amount of extraneous material that adheres to the conductive elements. Accordingly, the copper surfaces to be connected should be as clean as possible prior to and during the assembly process.

It would be advantageous to provide a system for electrically and structurally connecting circuits on separate printed circuit boards.

It would further be advantageous for this system of circuit connections to be simply constructed with a minimum of moving parts and assembly complexity.

Moreover, it would be advantageous to provide a system for electrically connecting circuits on separate boards while ensuring the highest degree of cleanliness prior to and during the final assembly.

It would also be advantageous to provide an electrical bond between separate circuits on respective circuit boards having a means for positive mechanical retention so that the possibility of eventual disconnection is minimized or eliminated.

It would further be advantageous to provide a system for connecting a plurality of separate conductors on abutting circuit boards such that positive retention is assured equally for all of the connected conductors.

SUMMARY OF THE INVENTION

It is the object of the invention to provide an improved connector between semiconductor module cards or boards. The connector should establish connections along the shortest possible distance, both in the wiring and in the connector itself. The connector should further provide positive mechanical retention and positive spring action. For uniform spring action at multiple connector contacts, high rigidity and stiffness are required.

Moreover, it is an object of the present invention to provide a system for cleaning the contacts between electrical conductors immediately prior to and during the making of electrical connections therebetween.

In accordance with the principles of the present invention there is provided a high density electrical connector for use between semiconductor module boards. The connector has a rigid member and a flexible member connected to it, which provides elastomeric contact pressure. The rigid and flexible members are embodied in a dual durometer rubber layer having a relatively high durometer layer for the rigid member and a relatively low durometer layer for the flexible member. The relatively low durometer layer has circuit connector leads disposed thereon on the side facing away from the relatively high durometer layer. During the positioning of the electrical conductor into the relatively low durometer layer by pressing against a circuit board, a wiping action occurs to clean dust particles and other contaminants from the connector surface prior to forming an electrically conductive bond thereon.

The foregoing and other objects, features and advantages of the invention will be apparent from the following more particular description of a preferred embodiment of the invention, as illustrated in the accompanying drawings.

BRIEF DESCRIPTION OF THE DRAWINGS

FIG. 3 is a perspective view of the multiple connector body according to present the invention;

FIG. 4 is an exploded cross-sectional side view of the multiple connector and circuit board according to the present invention;

FIG. 5 is a cross-sectional end view of the multiple connector, drawing to relative scale and taken along line 5—5 of FIG. 4.

DETAILED DESCRIPTION OF THE PREFERRED EMBODIMENT

Figure 1:
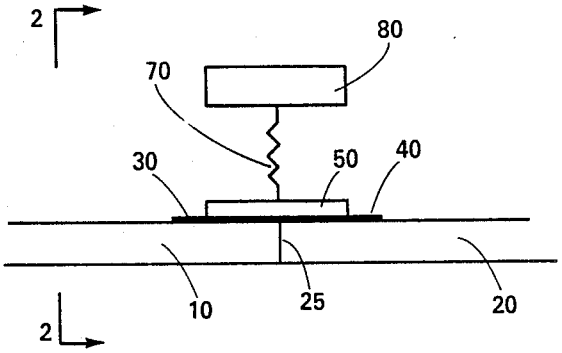
FIG. 1 is a schematic cross-sectional view of part of two abutting circuit boards and a multiple connector in accordance with the present invention across the edges thereof.

Referring now to FIG. 1, there is shown a first printed circuit board 10 on which is mounted one or more semiconductor modules and associated connecting circuits, not shown. The board 10 abuts a second printed circuit board 20 along common edges 25.

Disposed on printed circuit board 10 is a land 30, which terminates circuitry and is used to connect the semiconductor modules to outside devices. Circuit cards or boards carrying a highly integrated semiconductor module can have at least 50 lands per inch which are to be connected to corresponding lands on an abutting card or board. In spite of careful, automated manufacturing of the cards and attached lands to close tolerances, dimensional differences do occur and are compensated for by spring biasing as hereinbelow described. Corresponding to land 30 on printed circuit board 10 is another land 40 disposed on printed circuit board 20.

Extruded copper 50 is placed directly above the lands 30 and 40 and forms an electrical connection therebetween. It should be understood, however, that any electrically conductive material, such as platinum, aluminum and the like, can be used in place of copper 50. When oxidizable material such as copper is used, a plating process should be performed before connections are made. Gold or phosphor bronze plating of the copper lines 50 is preferred.

Surrounding the copper conductor 50 is a relatively resilient material 70 such as low durometer rubber. Any suitable polymer, such as polyvinyl chloride, thermoplastic elastomer (TPE) or the like with a durometer range of 60A–50D, can be used for this function. The resilient material 70 acts as a spring to urge the copper conductor 50 against the lands 30 and 40.

Bonded to the resilient material 70 is a more stiff, relatively high durometer rubber 80. Any high durometer material, such as styrene, acrylonitrile-butadiene-styrene (ABS), polypropylene or the like with a durometer range greater than 50D, may be used as the relatively stiff material 80, whose function it is to distribute a force transversely along the length of the common edges 25 of the boards 10 and 20.

Figure 2:
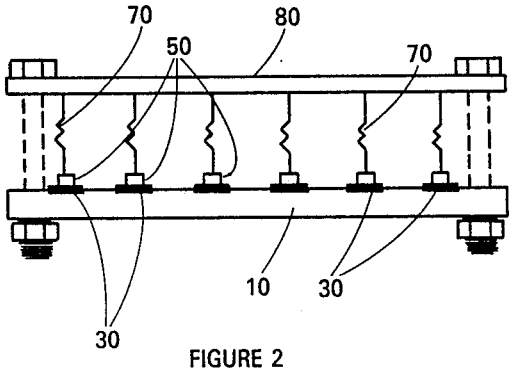
FIG. 2 is a side view of the multiple connector taken along line 2—2 of FIG. 1.

Referring now also to FIG. 2, there is shown a cross-sectional view taken along line 2—2 of FIG. 1. It can be seen that a plurality of lands 30 can be interconnected with corresponding adjacent lands, not shown in FIG. 2, and can be held in position by positive clamping action as hereinbelow further described. The multiple connector elements 50 formed of copper conductors are all spring loaded due to their relationship to the resilient material 70 in which they are embedded. The multiple connections between the multiple connector elements 50 and the lands 30 and 40 (FIG. 1) on cards 10 and 20 are made under positive spring pressure. When the relatively rigid, stiff member 80 bears down on the more resilient material 70, a substantially uniform pressure is urged against each individual connector element 50.

Referring now also to FIG. 3, there is shown the connector body, shown generally as reference numeral 210, made of dual durometer rubber. The resilient portion 70, for providing spring action, is in the upper position in FIG. 3. Bonded to the resilient material 70 is a more stiff material 80 to provide rigidity. As the connector body 210 is extruded from a suitable extruder, not shown, copper lines 50 are embedded in the resilient material portion 70 thereof. In FIG. 3, a horizontal arrow indicates the direction in which the connector body 210 and copper lines 50 are extruded.

The extrusion process can be performed by any suitable means well known in the art. By adding to this extrusion process coils of plated copper wire which are fed into the extrusion die, the wires 50 are bounded with the elastomer 70, thus providing the actual multiple connectors.

In the course of extrusion, the relatively low durometer material 70 is bonded to the high durometer material 80 by heat in the preferred embodiment. It should be understood that any suitable means of bonding is acceptable and, in fact, the connection between the low durometer and the high durometer material need not even be permanent. The extruded part 210 can be produced in various lengths and cut to the required engagement length. Clearance holes, not shown, are drilled or stamped in the connector body for mounting to an understructure.

Referring now also to FIG. 4, adjustable bolts or screws 160 and 170 are screwed into corresponding nuts 190 and 200 to mount and clamp the connector body 210, previously cut to length, to the printed circuit board 10. The copper wire conductors 50 are thereby clamped between the conductor body 210 and the printed circuit board 10. It should be understood that while nuts and bolts are shown in FIGS. 2 and 4 as the means for clamping the resilient rubber layer 70 to the printed circuit board 10, thereby sandwiching the copper lines 50 and lands 30, any suitable positive clamping means can be employed, such as snap latches and the like.

By applying a specified torque to nuts 190 and 200, the high durometer layer 80 is made to bear down upon low durometer layer 70, thus forcing the copper connector leads 50 against the lands 30 and 40 (FIG. 1) of the abutting cards or boards 10 and 20 with uniform pressure applied at each individual connection.

Thus the semiconductor module circuitry on card or board 10 is connected to the semiconductor module circuitry on card 20 through the connector device shown in detail in FIG. 4, providing multiple connections between the lands 30 on card 10 and corresponding lands 40 on card 20.

The high durometer layer 80 provides the required stiffness, while the low durometer layer 70 provides specified spring action and equal torque at each individual copper connector element 50.

Referring now also to FIG. 5, there is shown a cross-sectional view of the clamping device. One bolt 160 and corresponding nut 190 are used to clamp the connector body 210 (resilient material 70 facing down) to appropriately aligned and abutting printed circuit boards 10 and 20. The copper line 50 is sandwiched between the connector body 210 and the printed circuit boards 10 and 20 and forms an electrical connection between the lands 30 and 40 on the edges of the boards 10 and 20.

Figure 6:
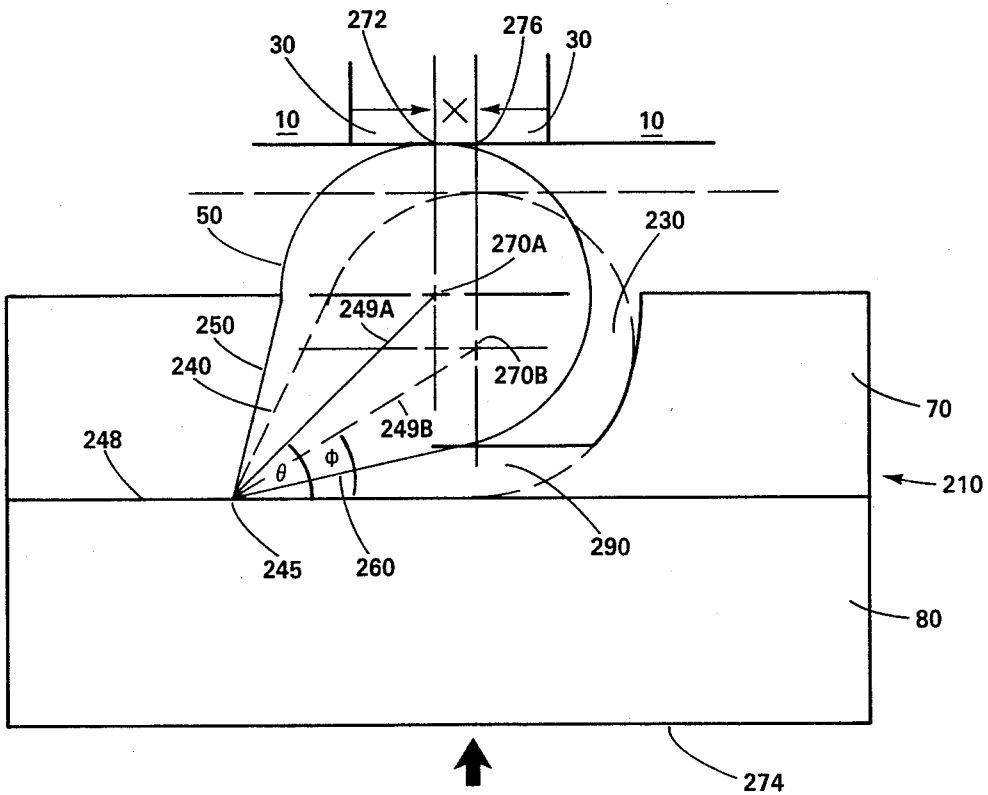
FIG. 6 is an exploded cross-sectional view of the multiple connector with a copper line positioned therein.

Referring now also to FIG. 6, there is shown an exploded cross-sectional view of one of the copper lines 50 embedded in the low durometer material 70 which, in turn, is bonded to the more rigid high durometer material 80.

A void 230 is originally manufactured in the low durometer material 70 for receiving the copper line or wire 50. The copper wire 50 is placed in the low durometer material 70 so that the center or origin 270*a* of the wire 50 lies substantially in the plane defined by the upper level of the low durometer material 70.

The copper wire 50 has a cross-section which is generally circular but includes a triangular protrusion 240 culminating in an apex 245 in the preferred embodiment. It should be understood that any acutely shaped protuberance having an apex may be used. The apex 245 of the protrusion 240 is affixed to a bond line 248 formed between the resilient rubber layer 70 and the hard rubber layer 80, substantially parallel to the outer surfaces thereof. The copper 50 is thus affixed to both the resilient material 70 and the hard material 80 at the apex 245.

The straight sides of the triangularly shaped protrusion 240 formed in the copper wire 50 are identified by reference numerals 250 and 260 respectively. Along these sides 250 and 260 of the copper wire 50 is bonded the resilient rubber 70. An angle $\theta$ is formed between the bond line 248 and an imaginary line 249*a* that bisects the protuberance 240, passing through the origin 270*a*. The size of the angle $\theta$ is significant in regard to wiping action as hereinbelow described.

The initial position of the copper line 50 relative to circuit board 10 is such that the copper line 50 touches the land 30 at a point identified by reference numeral 272. Reference numeral 30 is shown twice in FIG. 6, but both numerals refer to a single land.

When a constant vertical force is applied from the lower surface 274 of the relatively rigid rubber material 80, as indicated by a vertical arrow in FIG. 6, the copper wire 50 is pressed into the resilient rubber 70, filling the void 230 and decreasing angle $\theta$ linearly and proportionally. Point 245 forms a pivot around which the copper wire 50 is forced to rotate clockwise during the interconnection process. In the process of forcing the copper 50 into the resilient material 70, some of the resilient material 290 is displaced.

Dimension X is the displacement area of the lands 30 and 40, perpendicular to the common edges 25 (FIG. 1). As the copper 50 is pressed into the resilient material 70, the upper portion of the copper 50 is caused to rub against the lower surface of both cards 10 and 20 (FIG. 1) in a wiping action. The copper line 50 shifts position relative to the connector body 210. The final location of the copper line 50 is identified by phantom lines in FIG. 6. Also shown in phantom is the final position of the imaginary line 249*b* that bisects the triangular protuberance 240, forming one side of the apex 245 thereof and defining a final angle $\Phi$. Angle $\Phi$ is related to dimension X such that as $\theta$ decreases to $\Phi$, the wiped surface measured by X increases as the cosine of the angle. The area denoted as X, bounded by the initial contact position 272 between the copper wire 50 and land 30 and the final contact position 276, is cleaned of dust particles, contaminants, oxidation and the like during the interconnection process. Thus, the electrical resistance between the copper wire 50 and the two lands 30 and 40 of printed circuit boards 10 and 20 is greatly reduced due to wiping action. Thus, there is more predictability in the electrical performance of the overall system.

As the copper wire 50 is interconnected under pressure, the origin 270*a* of the copper wire 50 is displaced to its final position identified by reference numeral 270*b*. The copper line 50 and lands 30 and 40 are compressed and forced into contact along the major portion of area X.

From the foregoing description, it can be seen that connecting two separate lands on two separate printed circuit boards or cards respectively has been shown. This manner of connecting provides the shortest possible distance between the contact lands. Moreover, the manufacture of this connector is relatively inexpensive and space requirements are low.

While a preferred embodiment of the invention has been illustrated and described, it is to be understood that there is no intention to limit the invention to the precise constructions herein disclosed and the right is reserved to all changes and modifications coming within the scope of the invention as defined in the appended claims.

What is claimed is:

1. A device for electrically connecting two spaced apart lands comprising:

(a) a relatively rigid member;

(b) a compressible member operatively connected to said relatively rigid member along a bond line therebetween, said compressible member having a cavity for receiving a wire;

(c) an electrically conductive wire having an irregularly shaped cross-section having an acute protuberance shaped thereon, said protuberance being operatively connected to at least a portion of said bond line and said wire being seated in a first portion in said cavity and extending therefrom; and (d) two lands adjacent one another and adapted to move relative to said wire so that when said relatively rigid member is forced generally towards said lands, said wire is pivoted into contact with both of said lands in a wiping action to form an electrically conductive connection therebetween.

2. The device in accordance with claim 1 wherein said wiping activity of said portion of said lands removes contaminants therefrom.

3. A method for manufacturing a connector body adapted to complete an electrical circuit that includes lands on first and second circuit boards, the steps comprising:

(a) extruding a connector body consisting of a first layer of relatively high stiffness and a second layer of relatively resilient material bonded thereto, during which extruding step conductive wires are bonded to said resilient layer with said wires being exposed on a lower side of said resilient layer which is opposite to the upper side thereof on which said first layer is bonded; and (b) cutting the extruded body to a predetermined length to produce a connector body which can be pressed downwardly against said circuit boards to connect lands electrically on said first circuit board to lands on said second circuit board by means of said conductive wires.

4. The method in accordance with claim 3 wherein said wires are copper.

5. The method in accordance with claim 4, the steps further comprising:

(c) plating said wires with a non-oxiding material prior to bonding said resilient layer thereto.

6. The method in accordance with claim 5 wherein said non-oxiding material is gold.

7. The method in accordance with claim 5 wherein said non-oxiding material is phosphor bronze.

* * * * *